US009865937B1

(12) United States Patent
Wolf et al.

(10) Patent No.: US 9,865,937 B1
(45) Date of Patent: Jan. 9, 2018

(54) METHOD FOR FABRICATING RADIATING ELEMENT CONTAINMENT AND GROUND PLANE STRUCTURE

(71) Applicant: Rockwell Collins, Inc., Cedar Rapids, IA (US)

(72) Inventors: Jeremiah D. Wolf, Marion, IA (US); James B. West, Cedar Rapids, IA (US); Anna C. Kern, Robins, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 457 days.

(21) Appl. No.: 14/337,600

(22) Filed: Jul. 22, 2014

(51) Int. Cl.

| | |
|---|---|
| ***H01Q 21/00*** | (2006.01) |
| ***H01Q 21/06*** | (2006.01) |
| ***H01Q 1/48*** | (2006.01) |
| ***H01Q 1/50*** | (2006.01) |

(52) U.S. Cl.
CPC ..... *H01Q 21/064* (2013.01); *H01Q 1/48* (2013.01); *H01Q 1/50* (2013.01); *H01Q 21/0087* (2013.01); *Y10T 29/49016* (2015.01)

(58) Field of Classification Search
CPC ..... H01Q 21/0087; H01Q 21/061–21/068; H01Q 1/48; H01Q 1/50; Y10T 29/49016
See application file for complete search history.

(56) References Cited

U.S. PATENT DOCUMENTS

| | | | | |
|---|---|---|---|---|
| 5,786,792 | A * | 7/1998 | Bellus | H01Q 13/085 343/767 |
| 6,421,021 | B1 * | 7/2002 | Rupp | H01Q 13/085 343/753 |
| 8,466,846 | B1 * | 6/2013 | Elsallal | H01Q 1/38 343/700 MS |
| 9,472,860 | B1 * | 10/2016 | Wiser | H01Q 21/064 |
| 2007/0229380 | A1 * | 10/2007 | Oota | H01P 5/107 343/762 |
| 2014/0059840 | A1 * | 3/2014 | Thompson, Jr. | H01Q 1/12 29/600 |

* cited by examiner

*Primary Examiner* — Livius R Cazan
(74) *Attorney, Agent, or Firm* — Angel N. Gerdzhikov; Donna P. Suchy; Daniel M. Barbieri

(57) ABSTRACT

A method for fabricating a radiating element containment and ground plane structure. The method includes positioning post components, wherein each of the post components has at least one channel. The method further includes positioning a ground plane component including insertion slots and post attachment points. The method also includes attaching the post components to the ground plane component such that each post component is electrically grounded to the ground plane component.

17 Claims, 9 Drawing Sheets

METHOD FOR FABRICATING RADIATING ELEMENT CONTAINMENT AND GROUND PLANE STRUCTURE

FIELD OF THE INVENTION

Embodiments of the invention are directed generally toward a radiating element containment and ground plane structure apparatus and system, as well as a method for fabricating such an apparatus and system.

BACKGROUND

Ultra-wide band (UWB) active electronically scanned array (AESA) antennas (also known as phased array antennas) are important for next generation signal intelligence (SIGINT, such as electronic intelligence (ELINT) and communications intelligence (COMINT)) systems and for multi-function electronic warfare (EW), communications, and radar systems.

Existing UWB AESA antennas are expensive to manufacture and heavy. Proper electrical performance of UWB AESA antennas requires precise electrical interaction between printed circuit board (PCB) antenna radiating elements (e.g., balanced antipodal Vivaldi antenna radiating elements) and a radiating element containment and ground plane structure (sometimes referred to as a cradle, an "egg crate", or an "egg crate chassis"). For example, the radiating element containment and ground plane structure should have precisely designed shunt capacitance to ground between PCB antenna radiating elements and channels (e.g., U-shaped slots) of posts of the radiating element containment and ground plane structure. Additionally, UWB AESA antenna designs require precise mechanical tolerances in the radiating element containment and ground plane structure.

Because of the required precise electrical interaction and mechanical tolerances associated with the radiating element containment and ground plane structure, current radiating element containment and ground plane structures are costly to manufacture. Existing radiating element containment and ground plane structures are fabricated from a solid billet of aluminum by using a complex numerical control (CNC) machining process and a wire electrostatic deposition machining (EDM) process. Currently, each of the posts of the radiating element containment and ground plane structure are fabricated by performing the CNC machining process to remove aluminum from the solid aluminum billet which leaves the ground plane base and a plurality of posts. Existing wire EDM processes also include forming channels (e.g., U-shaped slots) in each post and PCB insertion slots in the ground plane base by using a wire electrode to burn through aluminum material one slot at a time. Because the radiating element containment and ground plane structure may include thousands of posts and thousands of slots, which are formed one at a time, such CNC machining and wire EDM processes are expensive and time consuming. Additionally, the resulting aluminum radiating element containment and ground plane structure is very heavy.

SUMMARY

In one aspect, embodiments of the inventive concepts disclosed herein are directed to a method for fabricating a radiating element containment and ground plane structure. The method includes positioning a plurality of post components, each of the plurality of post components having at least one channel, wherein at least one of the plurality of post components has four channels. The method further includes positioning at least one ground plane component, the at least one ground plane component including a plurality of insertion slots and a plurality post attachment points. The method also includes attaching the plurality of post components to the at least one ground plane component such that each post component is electrically grounded to the at least one ground plane component.

In a further aspect, embodiments of the inventive concepts disclosed herein are directed to a method for fabricating a radiating element containment and ground plane structure. The method includes positioning a plastic radiating element containment and ground plane structure, the plastic radiating element containment and ground plane structure having a plurality of posts and a ground plane base. The method further includes creating at least one channel in each of the plurality of posts of the plastic radiating element containment and ground plane structure. The method also includes creating at least one insertion slot in the ground plane base of the plastic radiating element containment and ground plane structure.

In yet another aspect, embodiments of the inventive concepts disclosed herein are directed to a method for fabricating a radiating element containment and ground plane structure. The method includes fabricating a plastic radiating element containment and ground plane structure, the plastic radiating element containment and ground plane structure including a plurality of posts and a ground plane base, wherein each post includes at least one channel, wherein the ground plane base includes a plurality of insertion slots. The method further includes depositing a layer of electrically conductive material on the plastic radiating element containment and ground plane structure.

Additional embodiments are described in the application including the claims. It is to be understood that both the foregoing general description and the following detailed description are exemplary and explanatory only and are not restrictive. Other embodiments of the invention will become apparent.

BRIEF DESCRIPTION OF THE FIGURES

Other embodiments of the invention will become apparent by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications, and equivalents are encompassed. For the purpose of clarity, technical material that is known in the technical fields related to the embodiments has not been described in detail to avoid unnecessarily obscuring the description.

Some embodiments of the invention include a fabricated radiating element containment and ground plane structure. The radiating element containment and ground plane structure is sometimes referred to as a cradle, an "egg crate", or "egg crate chassis". Other embodiments of the invention include fabricated component parts of a radiating element containment and ground plane structure. Still other embodiments include an assembled radiating element containment and ground plane structure comprising a plurality of fabricated component parts.

In some embodiments, the radiating element containment and ground plane structure is configured to contain a plurality of Vivaldi antenna elements, tapered slot antenna elements, transverse electromagnetic (TEM) horn antenna elements, or the like. As such, the radiating element containment and ground plane structure, which contains a plurality of antenna elements, may be implemented as an active electronically scanned array (AESA) antenna system (such as an ultra-wide band (UWB) AESA antenna system). For example, in some embodiments, the radiating element containment and ground plane structure may contain or may be configured to contain a plurality of balanced antipodal Vivaldi antenna (BAVA) elements and may be implemented as a BAVA AESA aperture.

Figure 1:
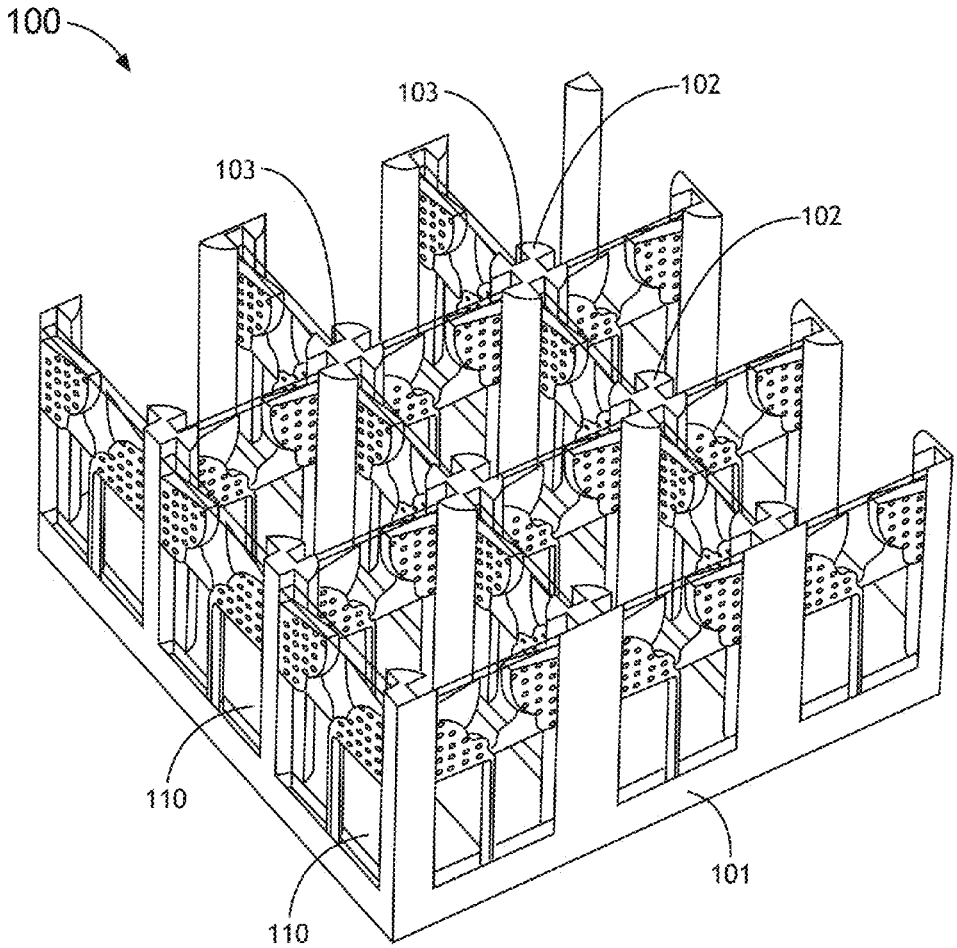
FIG. 1 shows an isometric view of a portion of an exemplary electronically scanned array (ESA) antenna system.
Figure 2:
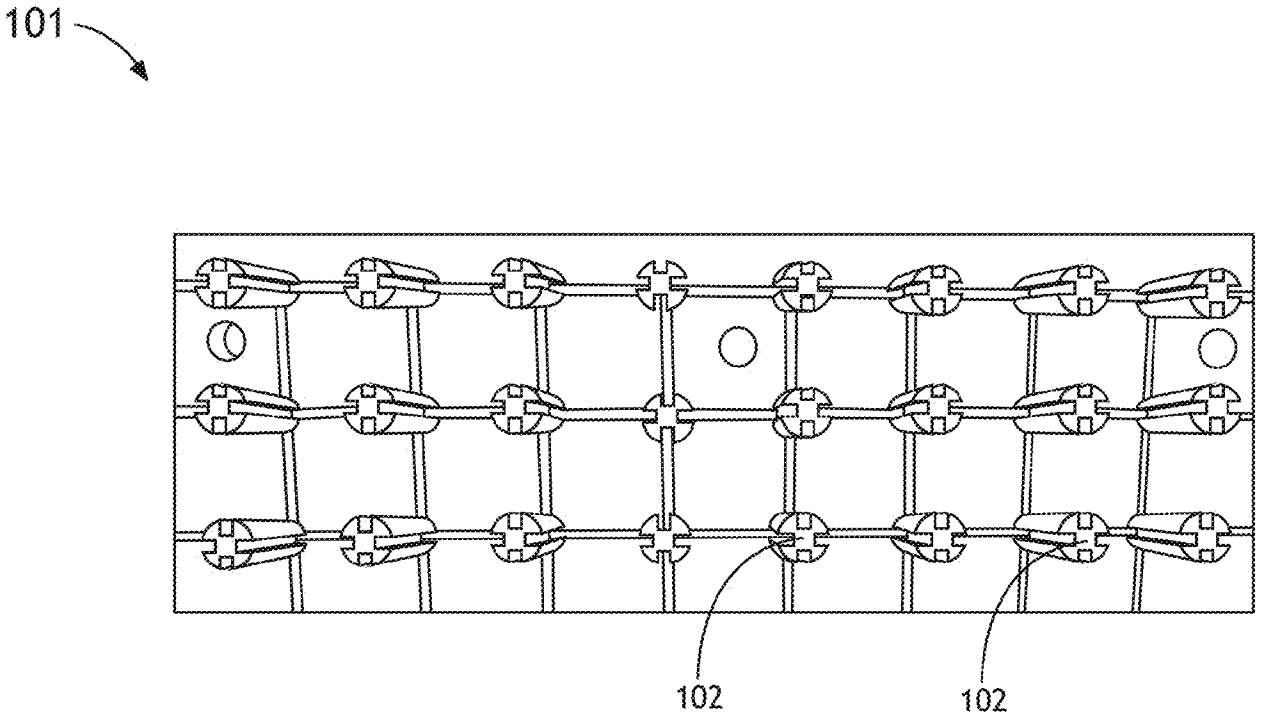
FIG. 2 shows an isometric top view of a portion of a radiating element containment and ground plane structure of an exemplary ESA antenna system.
Figure 3:
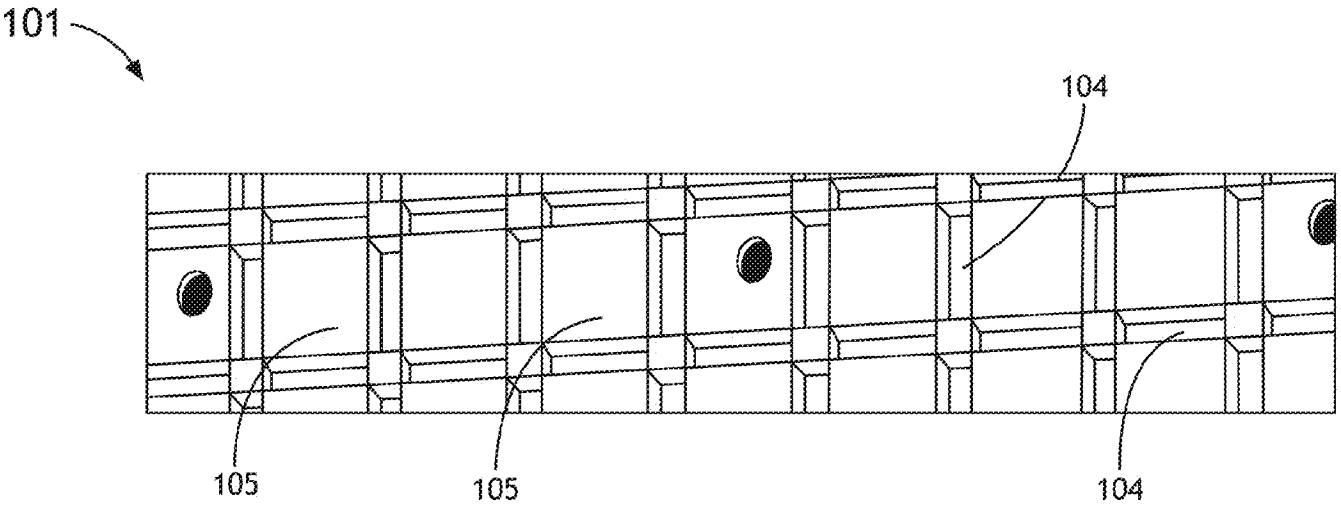
FIG. 3 shows a bottom view of a portion of a radiating element containment and ground plane structure of an exemplary ESA antenna system.

Referring now to FIGS. 1-3, views of portions of an exemplary electronically scanned array (ESA) antenna system 100 (e.g., a UWB AESA antenna system) are shown. The ESA antenna system 100 includes a radiating element containment and ground plane structure 101 and a plurality of antenna elements 110 (e.g., PCB antenna elements, BAVA elements, Vivaldi antenna elements, tapered slot antenna elements, transverse electromagnetic (TEM) horn antenna elements, or the like). The radiating element containment and ground plane structure 101 may include a plurality of posts 102 and a ground plane base portion 105. Currently, the plurality of posts 102 and the ground plane base portion 105 of the radiating element containment and ground plane structure 101 are machined from a solid billet of aluminum. Each of the posts 102 may include one or more (e.g., one, two, three, or four) channels (such as U-shaped slots) depending on whether the post is located on an edge of the ESA antenna system 100. The channels 103 of the posts 102 may be positioned to receive an orthogonal arrangement of rows of antenna elements 110 and columns of antenna elements 110. Each of the PCB antenna elements 110 is configured to slide into the channels 103 of the posts 102; that is, each of the channels 103 of the posts 102 is configured to receive an edge of an antenna element 110, which slides into a first channel 103 of a first post 102 and an oppositely facing channel 103 of a second post 102. A bottom edge of each of the antenna elements 110 is configured to slide into an insertion slot 104 (e.g., a PCB insertion slot), which extends from post 102 to post 102 through the ground plane 105 of the radiating element containment and ground plane structure 101.

In exemplary embodiments, each antenna element 110 may comprise a PCB BAVA element, wherein each PCB BAVA element has a dimension of approximately 0.328 inches from side edge to side edge such that each PCB BAVA element is configured to be loaded into oppositely facing channels 103 of two posts 102, wherein the oppositely facing channels 103 are spaced (e.g., spaced approximately 0.328 inches apart) to accommodate the particular PCB BAVA element. The particular exemplary PCB BAVA element may be configured to operate over a particular range of frequencies (e.g., 2 to 18 gigahertz (GHz)). While an exemplary PCB BAVA element having particular dimensions configured to operate over a particular frequency range has been presented for exemplary purposes, it is fully contemplated that embodiments of the invention may include any suitable antenna element type having any suitable dimensions configured to operate over any designed frequency range. Additionally, while FIG. 1 shows the exemplary ESA antenna system 100 as having 3×3 antenna elements 110 (i.e., 3 rows of antenna elements 110 and 3 columns of antenna elements 110), it is fully contemplated that suitable ESA antenna systems may have any number of antenna elements (e.g., any number of rows and columns of antenna elements in an m×n configuration).

In some embodiments, the radiating element containment and ground plane structure 101 may comprise a metal (e.g., aluminum, steel, copper, or the like), an alloy, a plated non-conductive material, plated plastic, or the like. In some embodiments where the radiating element containment and ground plane structure 101 is composed of a non-conductive material (e.g., plastic), the radiating element containment and ground plane structure 101 may be fabricated from a block of non-conductive material (e.g., plastic) and machined (e.g., drilling, sawing, a CNC machining process, a thermal cutting process, or the like). In some embodiments where the radiating element containment and ground plane structure 101 is composed of a non-conductive material (e.g, plastic), the radiating element containment and ground plane structure 101 may be formed through an injection molding process, a three-dimensional printing process, or the like. In such embodiments, where the radiating element containment and ground plane structure 101 is composed of a non-conductive material (e.g., plastic), a plating process may be performed on the radiating element containment and ground plane structure 101 to produce desired conductive properties on the surface of the radiating element containment and ground plane structure 101. The plating process of the non-conductive material (e.g., plastic) may comprise any suitable plating process which results in depositing a layer of electrically conductive material with desired conductive properties as would be appreciated by one of ordinary skill having the benefit of the instant disclosure. For example, the plating process may include painting, dipping, spraying, applying, coating, embedding, electroforming, electroplating, taping, and/or otherwise depositing an electrically conductive layer on a non-conductive material. Additionally, the plating process may include painting, dipping, spraying, applying, coating, embedding, electroforming, electroplating, taping, and/or otherwise depositing one or more intermediate or primer layers before painting, dipping, spraying, applying, coating, embedding, electroforming, electroplating, taping, and/or otherwise depositing an exterior electrically conductive layer.

Figure 4:
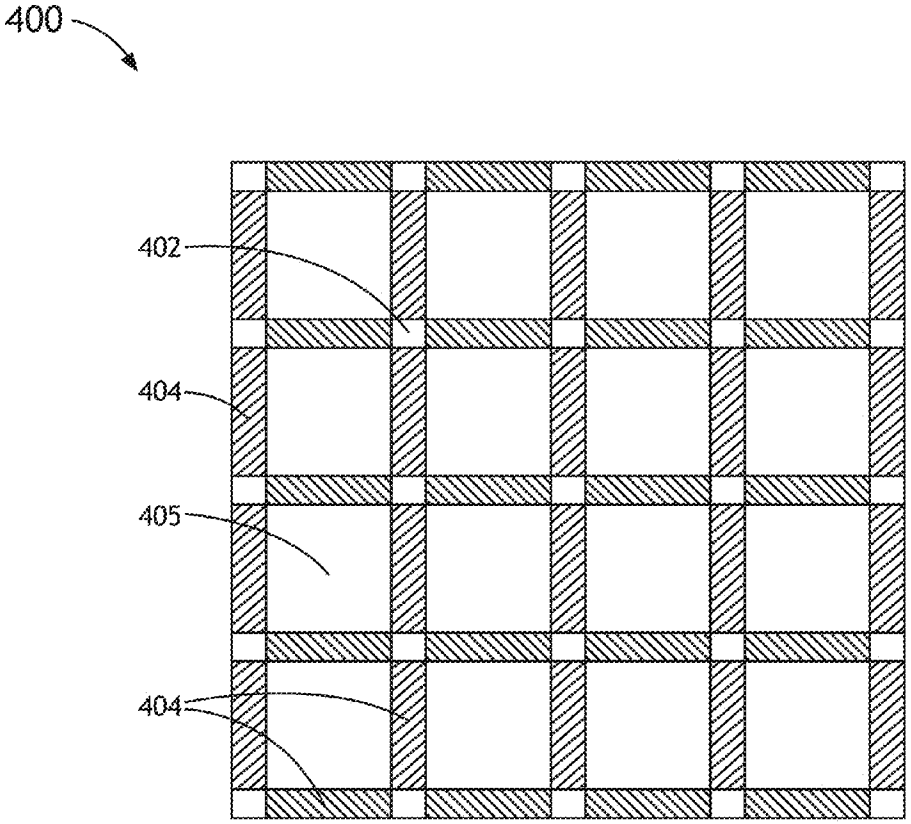
FIG. 4 depicts a top view of a ground plane component of some embodiments.
Figure 5:
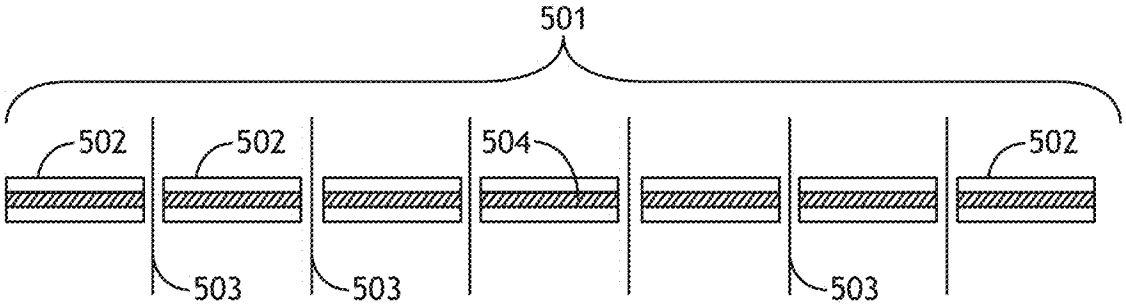
FIG. 5 depicts an automated machining process for fabricating a plurality of post components from a post rod of some embodiments.

Referring now to FIG. 4, a view of a ground plane component 400 configured to be implemented as part of a radiating element containment and ground plane structure of some embodiments is shown. In some embodiments, components of a radiating element containment and ground plane structure may be fabricated individually and assembled together to form the radiating element containment and ground plane structure. For example, as shown in FIG. 4, some embodiments include fabricating the ground plane component 400 separately from the posts, which may be attached later (that is, the posts may be fabricated separately (see, e.g., posts 502 as shown in FIG. 5) and attached in a separate fabrication process (see, e.g., FIGS. 6B-6C). Fabricating the ground plane component 400 without posts removes the need to perform a time consuming, channel forming EDM process on any posts as would typically be required in current fabrication of a radiating element containment and ground plane structure. That is, by fabricating the ground plane component 400 without posts, performing time consuming and expensive EDM processes to create each channel on each post of a radiating element containment and ground plane structure may be omitted. For example, fabricating the ground plane component 400 without posts allows a channel formation process (such as EDM processing) to be performed on the structure of a "long" single cylindrical rod all at once, and the long cylindrical rod can later be cut into a plurality of post components, which each have channels, as shown with respect to FIG. 5.

In some embodiments, the ground plane component 400 may be composed of a metal (e.g., aluminum, steel, copper, or the like), an alloy, a plated non-conductive material, plated plastic, or the like.

In some embodiments, the ground plane component 400 may be fabricated by performing a CNC machining process on a plate of aluminum. For example, a CNC machining process may be performed on a plate of aluminum by removing aluminum to create insertion slots 404 (e.g., PCB antenna element slots) in the ground plane component 400. The machining process may include removing a plurality of lines of insertions slots 404 in a first direction and removing a plurality of lines of insertions slots 404 in an orthogonal direction to the first direction. After creating the insertion slots 404, the ground plane component includes a plurality of orthogonally arranged rows and columns of insertion slots 404, ground base portions 405 (e.g., ground base portions 405 bounded by insertion slots 404 on four sides and by post attachment points 402 at the vertices of a top surface of the ground base portion 405), and post attachment points 402.

In some embodiments, the ground plane component 400 may comprise non-conductive material (e.g., plastic). In some exemplary embodiments, the ground plane component 400 may fabricated from a sheet of plastic and machined (e.g., drilling, sawing, a CNC machining process, a thermal cutting process, or the like) to include a plurality of orthogonally arranged rows and columns of insertion slots 404, ground base portions 405 (e.g., ground base portions 405 bounded by insertion slots 404 on four sides and by post attachment points 402 at the vertices of a top surface of the ground base portion 405), and post attachment points 402. In other exemplary embodiments, the ground plane component 400 may be formed through an injection molding process, a three-dimensional printing process, or the like to form the ground plane component 400 which includes a plurality of orthogonally arranged rows and columns of insertion slots 404, ground base portions 405 (e.g., ground base portions 405 bounded by insertion slots 404 on four sides and by post attachment points 402 at the vertices of a top surface of the ground base portion), and post attachment points 402. In some embodiments, a plating process may be performed on the plastic ground plane component 400 to produce desired conductive properties on the surface of the plastic ground plane 400. The plating process of the non-conductive material (e.g., plastic) may comprise any suitable plating process which results in depositing a layer of electrically conductive material with desired conductive properties as would be appreciated by one of ordinary skill having the benefit of the instant disclosure. For example, the plating process may include painting, dipping, spraying, applying, coating, embedding, electroforming, electroplating, taping, and/or otherwise depositing an electrically conductive layer on a non-conductive material. Additionally, the plating process may include painting, dipping, spraying, applying, coating, embedding, electroforming, electroplating, taping, and/or otherwise depositing one or more intermediate or primer layers before painting, dipping, spraying, applying, coating, embedding, electroforming, electroplating, taping, and/or otherwise depositing an exterior electrically conductive layer.

Additionally, some embodiments include creating post attachment points 402 on the ground plane component 400. The post attachment points 402 may be implemented as portions of the ground plane component 400 configured to attach to post components 502. For example, each of the post attachment points 402 may comprise a registration hole (e.g., formed by partially drilling a hole into the ground plane component 400 at a location of the post attachment point, formed by performing a CNC machining process, or the like), a surface (e.g., a flat surface, a roughed-up surface, or the like), a boss 601 (e.g., attached to the ground plane component 400, formed through a CNC machining process, or the like), an attachment pin 602, a bracket, or the like. Post components 502 may be attached to the ground plane component 400 at the post attachment points 402.

Referring now to FIG. 5, an automated machining process for fabricating a plurality of post components 502 from a post rod 501 is shown. In some embodiments, the post rod 501 may be composed of a metal (e.g., aluminum, steel, copper, or the like), an alloy, a non-conductive material, plastic, or the like. In some embodiments, the machining process may include performing a channel formation process. In some embodiments, performing the channel formation process may include forming one, two, three, or four U-shaped slots in the post rod 501. In some embodiments, the channel formation process may comprise machining the post rod 501 by using saw cutters, drilling bits, thermal cutting elements, or the like to form channels 504 (e.g., U-shaped slots) lengthwise along the post rod 501. For example, four channels 504 may be precisely machined on each post rod 501, such that the each of the channels 504 run in a parallel direction lengthwise down the post rod 501 with each channel 504 being oriented approximately 90 degrees radially about an axis of the post rod 501 with respect to adjacent channels 504. Upon performing the channel formation process on the post rod 501 to include one or more channels 504 (e.g., one, two, three, or four), the machining process may include performing a segmentation process on the post rod 501 to convert the post rod 501 into a plurality of post components 502. Performing the segmentation process on the post rod 501 may include machining the post rod 501 by utilizing a saw, a slicer mechanism, a thermal cutting element, or the like to segment the post rod 501 at precisely measured cut lines 503 into the plurality of post components 502. In some embodiments, a plating process may be performed on the plurality of post components 502 to produce desired conductive properties on the surface of each of the plurality of post components 502. The plating process of the non-conductive material (e.g., plastic) may comprise any suitable plating process which results in depositing a layer of electrically conductive material with desired conductive properties as would be appreciated by one of ordinary skill having the benefit of the instant disclosure. For example, the plating process may include painting, dipping, spraying, applying, coating, embedding, electroforming, electroplating, taping, and/or otherwise depositing an electrically conductive layer on a non-conductive material. Additionally, the plating process may include painting, dipping, spraying, applying, coating, embedding, electroforming, electroplating, taping, and/or otherwise depositing one or more intermediate or primer layers before painting, dipping, spraying, applying, coating, embedding, electroforming, electroplating, taping, and/or otherwise depositing an exterior electrically conductive layer.

In some embodiments, the post components 502 may be formed through an injection molding process or three-dimensional printing process with channels 504. In other embodiments, the post components 502 may be formed through an injection molding process or three-dimensional printing process without channels 504, and the channel formation process may be performed on the cylindrical posts to form the channels 504 in the post components 502.

Figure 6A:
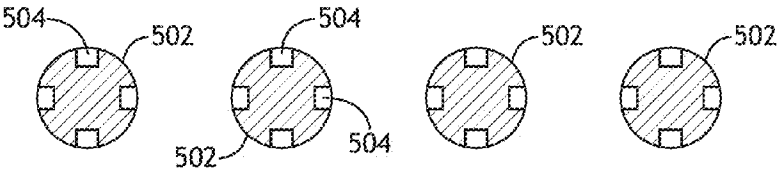
FIG. 6A depicts a cross-sectional view of four post components of some embodiments.
Figure 6B:
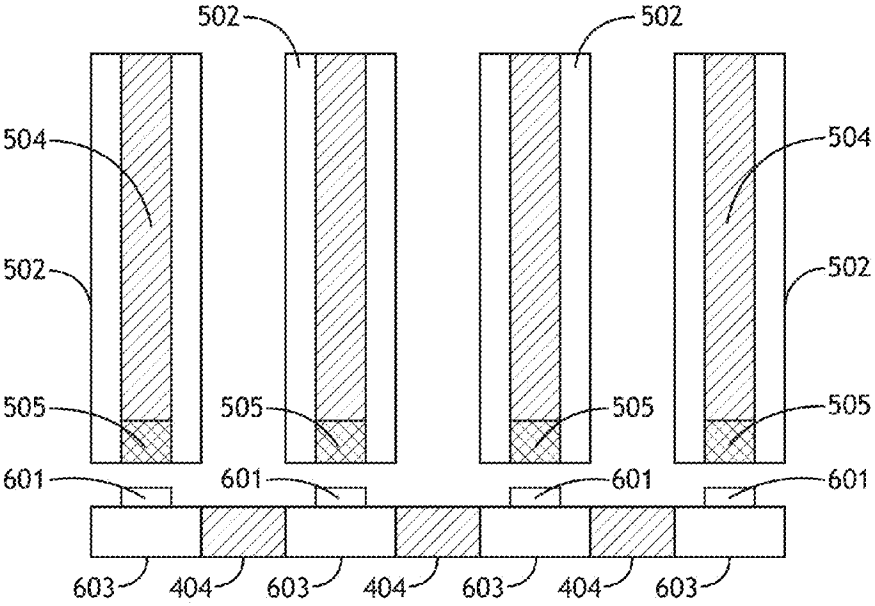
FIG. 6B depicts an exemplary automated attachment process of post components to the ground plane component of an exemplary embodiment.
Figure 6C:
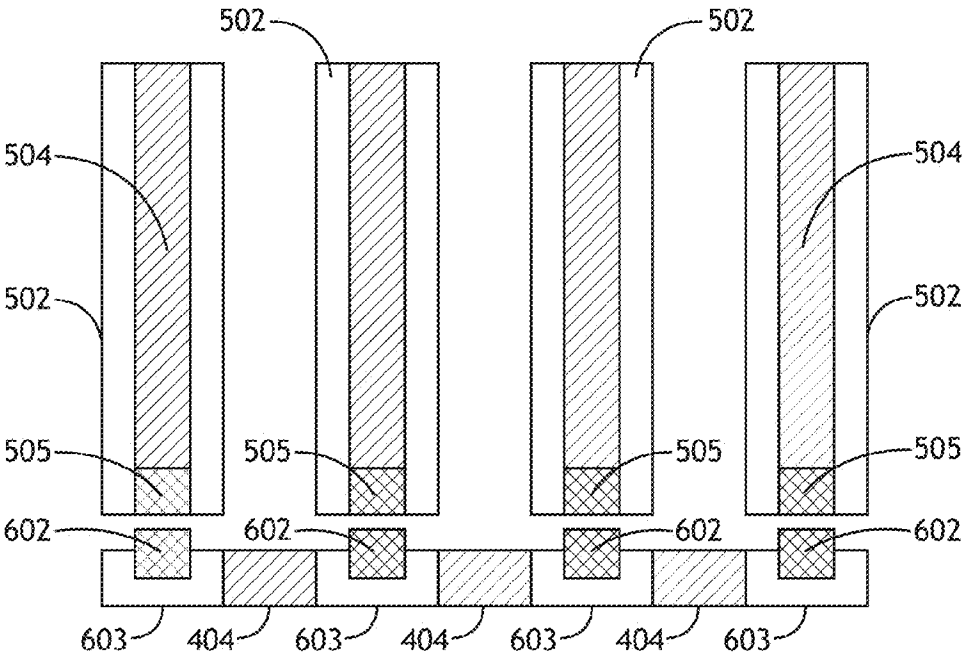
FIG. 6C depicts a further exemplary automated attachment process of post components to the ground plane component of a further exemplary embodiment.

Referring now to FIGS. 6A-6C, exemplary views, which depict an automated attachment process of post components 502 to the ground plane component 400 of some embodiments, are shown.

FIG. 6A shows a cross-sectional view of four cylindrical post components 502 of exemplary embodiments, wherein each cylindrical post component 502 includes four channels 504 (e.g., U-shaped slots).

Referring now to FIG. 6B, an exemplary embodiment of an automated attachment process for attaching post components 502 to the ground plane component 400 is shown. The automated attachment process may include the use of robotic assembly to attach the cylindrical posts components 502 to the ground plane component 400. The ground plane portions 603 of the ground plane component 400 may include bosses 601 configured to insert into a registry hole 505 at the base of a post component 502. The post components 502 may be aligned during the attachment process such that the channels of the post components 502 align with the channels of other attached post components 502. Each boss 601 and a corresponding registry hole 505 may be press fit or metallically bonded to maintain ground continuity between the ground plane component 400 and each post component 502.

Referring now to FIG. 6C, an embodiment of an exemplary automated attachment process for attaching post components 502 to the ground plane component 400 is shown. The automated attachment process may include the use of robotic assembly to attach the cylindrical posts components 502 to the ground plane component 400. The ground plane portions 603 of the ground plane component 400 may include pins 602 configured to insert into a registry hole 505 at the base of a post component 502. The post components 502 may be aligned during the attachment process such that the channels of the post components 502 align with the channels of other attached post components 502. Each pin 602 and a corresponding registry hole 505 may be press fit or metallically bonded to maintain ground continuity between the ground plane component 400 and each post component 502.

In some embodiments, the base of each post component 502 may be metallically bonded to a corresponding attachment point 402 of the ground plane component 400.

Figure 7A:
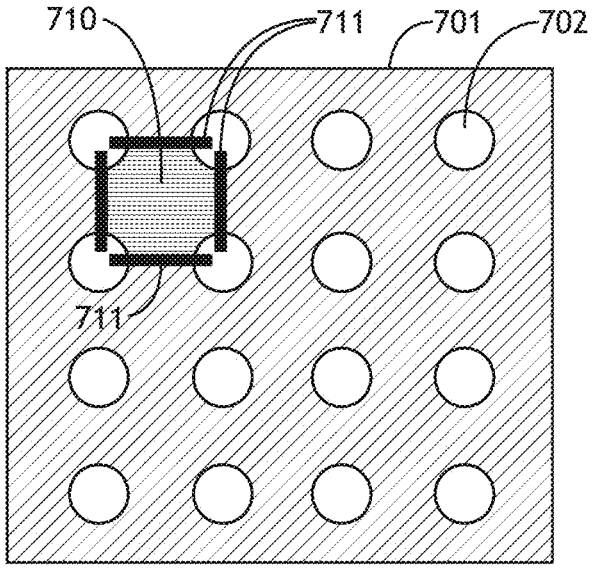
FIG. 7A depicts electrodes of an electrode fixture configured for precision thermal cutting of a plastic radiating element containment and ground plane structure.
Figure 7B:
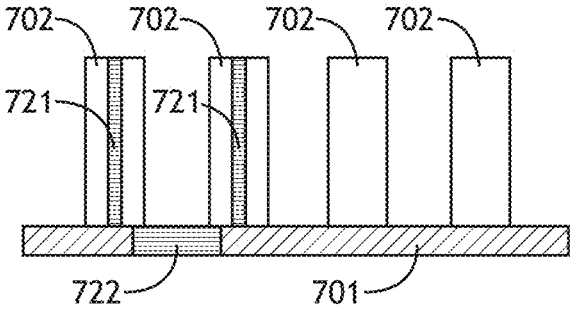
FIG. 7B depicts a plastic radiating element containment and ground plane structure having thermally formed insertion slots and channels of some embodiments.

Referring now to FIGS. 7A-7B, electrode filaments 711 of an electrode fixture 710 configured for precision thermal cutting and a plastic radiating element containment and ground plane structure are depicted. The plastic radiating element containment and ground plane structure may be fabricated through an injection molding process or three-dimensional printing process. The plastic radiating element containment and ground plane structure may comprise a ground plane base portion 701 and a plurality of cylindrical posts 702. In some embodiments, the plastic radiating element containment and ground plane structure may comprise a single plastic structure, while in some embodiments, the plastic radiating element containment and ground plane structure may comprise at least two interlockable and/or attachable sections (e.g., as described with respect to FIG. 8, below), wherein each section comprises a single plastic structure.

A thermal cutting tool may comprise an electrode fixture 710 and one or more (e.g., one, two, three, four, . . . , ten, . . . , 24, . . . , 40, . . . , 480, . . . , 19,800, or more) electrode filaments 711. In particular exemplary embodiments, the electrode filaments 711 may each comprise a rectangular electrode filament, which may be brought to a high temperature by passing DC (direct current) electrical current through the rectangular electrode filament. The thermal cutting tool may precisely position and insert the heated filaments 711 into the plastic radiating element containment and ground plane structure such that side edges of the heated rectangular electrode filaments 711 burn, melt, cut, or otherwise form channels 721 (e.g., U-shaped slots) into the cylindrical posts 702 and bottom edges of the heated rectangular electrode filaments 711 burn, melt, cut, or otherwise form insertion slots 722 (e.g., PCB insertion slots, PCB BAVA insertion slots, or the like) into the ground plane base portion 701. While thermal cutting fixture 710 as depicted in FIG. 7A only shows four electrode filaments 711 configured to burn channels 721 and insertion slots 722 for a single unit cell (e.g., a single BAVA unit cell), the thermal cutting fixture 710 may comprise an array of any number of electrode filaments 711 configured to simultaneously create any number of channels 721 and insertion slots 722, for example in any suitable m×n array. Such a simultaneous, parallel slot creation by "burning" up to four slots per post in the m×n egg crate assembly, in conjunction with injection molding or 3D printing of the egg crate assembly, allows for high throughput, time efficiency, and low cost manufacturing of the complex mechanical structure. Additionally, in some embodiments, post-plating processes may be highly automated. For example, the antenna elements 110 (e.g., PCB antenna elements), which may include the printed circuits that contain radiating elements, can be automatically inserted into the egg crate assembly at low cost and high speed to form an AESA.

In some embodiments, once the channels 721 have been formed into the posts 702 and the insertion slots 722 have been formed into the ground base plane portion 701, the fabrication process may include performing a plating process on the plastic radiating element containment and ground plane structure with channels 721 and insertion slots 722 to produce desired conductive properties on the surface of the plastic radiating element containment and ground plane structure. The plating process of plastic may comprise any suitable plastic plating process which results in desired conductive properties as would be appreciated by one of ordinary skill having the benefit of the instant disclosure.

Figure 8:
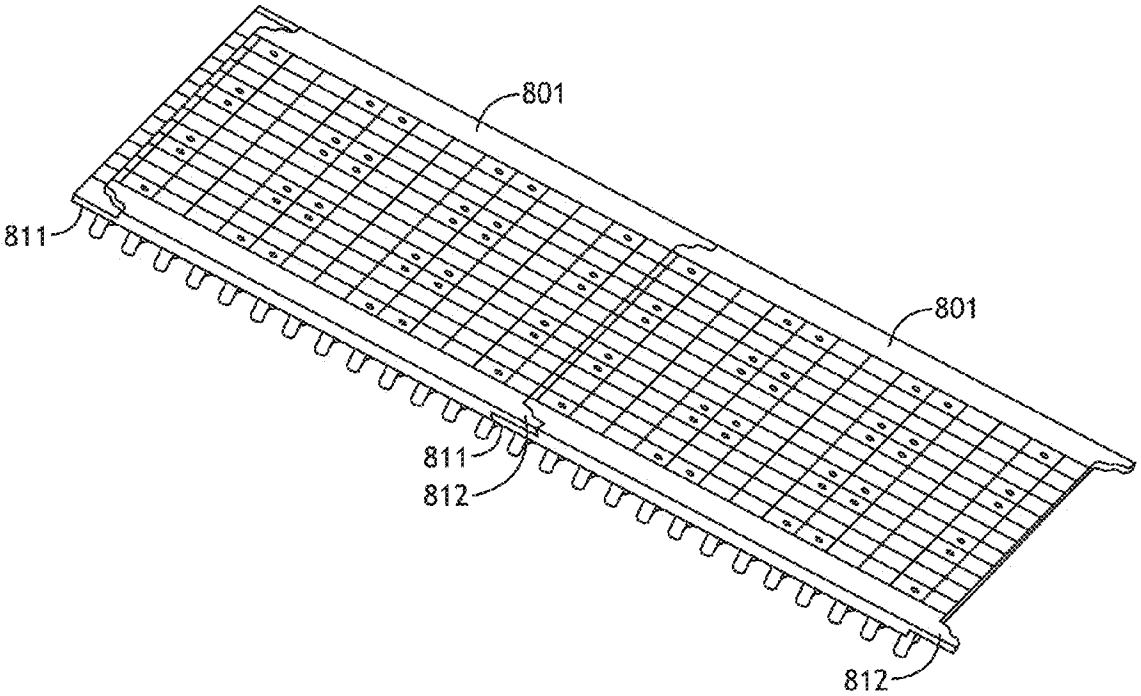
FIG. 8 depicts a bottom view of two attachable and/or interlockable sections of a radiating element containment and ground plane structure of some embodiments.

Referring now to FIG. 8, a bottom view of two attachable and/or interlockable sections 801 of a radiating element containment and ground plane structure of some embodiments is shown. In some embodiments, the radiating element containment and ground plane structure may be composed of multiple radiating element containment and ground plane structure sections 801. Each of the sections 801 are configured to interlock and/or attach to another section via attachments means 811, 812 (such as interlocking top portions and bottom portions, snap-together mechanisms, or the like). For example, the radiating element containment and ground plane structure may include a collection of sections 801 (each section having a sub-array of m×n elements), the collection of sections 801 being arranged in a k×l array of sections 801. Constructing a larger radiating element containment and ground plane structure from a plurality of interconnected sections 801 allows for the implementation of any of various sized radiating element containment and ground plane structures without using manufacturing equipment specifically set up for a specifically sized radiating element containment and ground plane structure. Further, utilizing a plurality of interconnected sections 801 allows for sections to be easily serviced or replaced without removing or replacing an entire radiating element containment and ground plane structure.

In the present disclosure, the methods, operations, and/or functionality disclosed may be implemented as sets of instructions or software stored in non-transitory computer readable medium and executable by a device. Further, it is understood that the specific order or hierarchy of steps in the methods, operations, and/or functionality disclosed are examples of exemplary approaches. Based upon design preferences, it is understood that the specific order or hierarchy of steps in the methods, operations, and/or functionality can be rearranged while remaining within the disclosed subject matter. The accompanying claims may present elements of the various steps in a sample order, and are not necessarily meant to be limited to the specific order or hierarchy presented.

It is believed that embodiments of the present invention and many of its attendant advantages will be understood by the foregoing description, and it will be apparent that various changes can be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for fabricating a radiating element containment and ground plane structure, comprising:

positioning a plurality of post components, each of the plurality of post components having at least one channel, wherein at least one of the plurality of post components has four channels, wherein the plurality of post components are composed of a non-conductive material;

depositing a layer of electrically conductive material on the plurality of post components;

positioning at least one ground plane component, the at least one ground plane component including a plurality of insertion slots and a plurality post attachment points, wherein the at least one ground plane component is composed of a non-conductive material;

depositing a layer of electrically conductive material on the at least one ground plane component; and attaching the plurality of post components to the at least one ground plane component such that each post component is electrically grounded to the at least one ground plane component.

2. The method of claim 1, wherein the at least one ground plane component comprises at least two ground plane components.

3. The method of claim 2, wherein each of the at least two ground plane components are configured to attach to each other.

4. The method of claim 3, further comprising:

attaching each of the at least two ground plane components to each other.

5. The method of claim 1, further comprising:

fabricating the plurality of post components from one or more post rods.

6. The method of claim 1, further comprising:

fabricating the at least one ground plane component.

7. A method for fabricating a radiating element containment and ground plane structure, comprising:

positioning a plastic radiating element containment and ground plane structure, the plastic radiating element containment and ground plane structure having a plurality of posts and a ground plane base, wherein positioning the plastic radiating element containment and ground plane structure further comprises:

positioning the plastic radiating element containment and ground plane structure to be aligned with at least one electrode filament;

creating at least one channel in each of the plurality of posts of the plastic radiating element containment and ground plane structure; and creating at least one insertion slot in the ground plane base of the plastic radiating element containment and ground plane structure.

8. The method of claim 7, wherein creating the at least one channel in each of the plurality of posts of the plastic radiating element containment and ground plane structure further comprises:

creating, via the at least one electrode filament, the at least one channel in each of the plurality of posts of the plastic radiating element containment and ground plane structure.

9. The method of claim 7, wherein creating the at least one insertion slot in the ground plane base of the plastic radiating element containment and ground plane structure further comprises:

creating, via the at least one electrode filament, the at least one insertion slot in the ground plane base of the plastic radiating element containment and ground plane structure.

10. The method of claim 7, further comprising:

upon creating the at least one channel in each of the plurality of posts of the plastic radiating element containment and ground plane structure and creating the at least one insertion slot in the ground plane base of the plastic radiating element containment and ground plane structure, depositing a layer of electrically conductive material on the plastic radiating element containment and ground plane structure.

11. A method for fabricating a radiating element containment and ground plane structure, comprising:

fabricating a plastic radiating element containment and ground plane structure, the plastic radiating element containment and ground plane structure including a plurality of posts and a ground plane base, wherein each post includes at least one channel, wherein the ground plane base includes a plurality of insertion slots, wherein fabricating the plastic radiating element containment and ground plane structure comprises:

positioning the plastic radiating element containment and ground plane structure to be aligned with at least one electrode filament;

creating at least one channel in each of the plurality of posts of the plastic radiating element containment and ground plane structure; and creating at least one insertion slot in the ground plane base of the plastic radiating element containment and ground plane structure; and depositing a layer of electrically conductive material on the plastic radiating element containment and ground plane structure.

12. The method of claim 11, wherein fabricating the plastic radiating element containment and ground plane structure further comprises:

fabricating the plastic radiating element containment and ground plane structure by performing an injection molding process.

13. The method of claim 11, wherein fabricating the plastic radiating element containment and ground plane structure further comprises:

fabricating the plastic radiating element containment and ground plane structure by performing a three-dimensional printing process.

14. The method of claim 11, wherein the plastic radiating element containment and ground plane structure comprises a plurality of sections, wherein each of the plurality of sections are configured to attach to each other.

15. The method of claim 14, further comprising:

attaching at least one section of the plurality of sections to another section of the plurality of sections.

16. The method of claim 11, wherein creating the at least one channel in each of the plurality of posts of the plastic radiating element containment and ground plane structure further comprises:

creating, via the at least one electrode filament, the at least one channel in each of the plurality of posts of the plastic radiating element containment and ground plane structure.

17. The method of claim 11, wherein creating the at least one insertion slot in the ground plane base of the plastic radiating element containment and ground plane structure further comprises:

creating, via the at least one electrode filament, the at least one insertion slot in the ground plane base of the plastic radiating element containment and ground plane structure.

* * * * *